US009583869B2

(12) United States Patent
Shindo et al.

(10) Patent No.: US 9,583,869 B2
(45) Date of Patent: Feb. 28, 2017

(54) CONNECTOR AND ELECTRICAL CONNECTION DEVICE

(71) Applicant: J.S.T. Mfg. Co., Ltd., Osaka-shi (JP)

(72) Inventors: Satoru Shindo, Yokohama (JP); Shinji Tasaka, Miyoshi (JP); Hitoshi Ozaki, Aichi (JP); Kazutaka Hattori, Aichi (JP)

(73) Assignee: J.S.T. MFG. CO., LTD., Osaka-shi (JP)

( * ) Notice: Subject to any disclaimer, the term of this patent is extended or adjusted under 35 U.S.C. 154(b) by 0 days.

(21) Appl. No.: 15/042,457

(22) Filed: Feb. 12, 2016

(65) Prior Publication Data

US 2016/0294109 A1 Oct. 6, 2016

(30) Foreign Application Priority Data

Mar. 30, 2015 (JP) ..... 2015-069073

(51) Int. Cl.
*H01R 24/20* (2011.01)
*H01R 13/533* (2006.01)
*H01R 31/06* (2006.01)

(52) U.S. Cl.
CPC ..... *H01R 13/533* (2013.01); *H01R 31/06* (2013.01)

(58) Field of Classification Search
CPC ..... H01R 13/533; H01R 31/06
USPC ..... 439/357, 328, 513, 511, 507, 512, 626
See application file for complete search history.

(56) References Cited

U.S. PATENT DOCUMENTS 4,738,631 A * 4/1988 Takahashi ..... H01R 13/02 439/246
4,813,880 A * 3/1989 Kramer ..... H04Q 1/142 439/507
5,106,324 A * 4/1992 Natsume ..... H01H 85/2035 439/510
5,711,681 A * 1/1998 Hasegawa ..... H01R 31/08 439/507
6,123,553 A * 9/2000 Kobayashi ..... H01R 13/7034 439/513
6,383,011 B2 * 5/2002 Chen ..... H01R 13/6273 439/357

(Continued)

FOREIGN PATENT DOCUMENTS

JP 2014-10949 A1 1/2014

*Primary Examiner* — Abdullah Riyami
*Assistant Examiner* — Nelson R Burgos-Guntin
(74) *Attorney, Agent, or Firm* — Kratz, Quintos & Hanson, LLP

(57) ABSTRACT

Provided is a connector having excellent vibration resistance. The invention applies to a connector including a terminal portion and a connector housing in which the terminal portion is accommodated and electrically connecting a first object to be connected and a second object to be connected via the terminal portion. A main body-side male contact is connected to the first object to be connected. A main body-side female contact is connected to the second object to be connected. The terminal portion has a connector-side male contact that is inserted into the main body-side female contact, a connector-side female contact into which the main body-side male contact is inserted, and an elastically deformable joint portion that joins the connector-side male contact and the connector-side female contact to each other.

5 Claims, 11 Drawing Sheets

(56) References Cited

U.S. PATENT DOCUMENTS

| | | | | |
|---|---|---|---|---|
| 8,845,349 | B2 * | 9/2014 | Shindo | H01R 13/6315 439/247 |
| 9,054,450 | B2 * | 6/2015 | Nagasaki | H01R 12/585 |
| 9,172,172 | B2 * | 10/2015 | Shindo | H01R 13/46 |
| 9,190,770 | B2 * | 11/2015 | Shindo | H01R 13/62 |
| 2013/0084751 | A1 * | 4/2013 | Shindo | H01R 13/6315 439/626 |
| 2015/0111419 | A1 | 4/2015 | Komiyama | |
| 2015/0222039 | A1 * | 8/2015 | Akiguchi | H01R 13/14 439/746 |
| 2016/0294100 | A1 * | 10/2016 | Shindo | H01R 13/502 |
| 2016/0294109 | A1 * | 10/2016 | Shindo | H01R 31/06 |

* cited by examiner

CONNECTOR AND ELECTRICAL CONNECTION DEVICE

CROSS-REFERENCE TO RELATED APPLICATION

This application is based upon and claims the benefit of priority from Japanese patent application No. 2015-69073, the entire disclosure of which is hereby incorporated by reference.

BACKGROUND OF THE INVENTION

1. Field of the Invention

The present invention relates to a connector that electrically connects two objects to be connected, and an electrical connection device including this connector.

2. Description of Related Art

For example, JP 2014-010949A discloses a connector such as that shown in FIG. 1 as a connector that electrically connects two objects to be connected. This connector has two female terminals (a first female terminal and a second female terminal). The first female terminal comes into contact with a first male terminal provided in one object to be connected, while the second female terminal comes into contact with a second male terminal provided in the other object to be connected.

In the above-described connector, the first female terminal and the second female terminal are joined to each other by an elastic joint piece so as to have vibration resistance. This elastic joint piece is configured to allow the first female terminal and the second female terminal to be independently displaced relative to each other in a direction in which the male terminals are to be inserted and removed. Thus, vibration resistance of the female terminals that are brought into contact with the male terminals respectively connected to the two objects to be connected having different vibration patterns can be improved.

However, even when a connector such as that described above is employed, there are cases where vibration resistance is insufficient.

SUMMARY OF THE INVENTION

The present invention was made to address the above-described problem, and it is an object thereof to provide a connector and an electrical connection device that have excellent vibration resistance.

(1) To address the above-described problem, a connector according to an aspect of the invention is a connector including a terminal portion and a connector housing in which the terminal portion is accommodated and electrically connecting a first object to be connected and a second object to be connected via the terminal portion, wherein a main body-side male contact formed as a male contact is connected to the first object to be connected, a main body-side female contact formed as a female contact is connected to the second object to be connected, and the terminal portion has a connector-side male contact that is inserted into the main body-side female contact, a connector-side female contact into which the main body-side male contact is inserted, and an elastically deformable joint portion that joins the connector-side male contact and the connector-side female contact to each other.

With this configuration, the connector-side male contact is connected to the main body-side female contact, and the connector-side female contact is connected to the main body-side male contact. Thus, the first object to be connected and the second object to be connected can be electrically connected to each other.

Moreover, with this configuration, as described above, the male contact is formed on one side of the terminal portion, and the female contact is formed on the other side of the terminal portion. This configuration enables the joint portion to have a longer length than in the case where female contacts are formed at both end portions of the terminal portion, for example. More specifically, since the male contact has a simplified configuration and a small size when compared with the female contact, the male contact-side end portion of the joint portion can be formed so as to extend to the male contact side. Thus, the length of the joint portion of the terminal portion can be longer when compared with the case where female contacts are formed at both end portions of the terminal portion. As a result, even if the two objects to be connected vibrate independently of each other, the vibrations can be absorbed by the joint portion having a secured sufficient length.

Therefore, with this configuration, a connector having excellent vibration resistance can be provided.

(2) It is preferable that the joint portion has a first straight line portion that is connected to the connector-side male contact on one end side, a second straight line portion that is connected to the connector-side female contact on one end side, the second straight line portion being provided extending parallel to the first straight line portion, and a connecting portion that connects another end side of the first straight line portion and another end side of the second straight line portion to each other, the connecting portion being provided extending in a direction that is orthogonal to the first straight line portion and the second straight line portion.

With this configuration, the joint portion is formed to have a U shape, and therefore it is possible to accommodate the terminal portion in a limited space within the connector housing while securing a sufficient length of the joint portion.

(3) It is more preferable that a bent portion is formed in the first straight line portion.

This configuration enables the joint portion to have a longer length when spread out, and therefore a connector having more excellent vibration resistance can be provided. Furthermore, with this configuration, spring properties can be imparted to the aforementioned bent portion, and therefore a connector having even more excellent vibration resistance can be provided.

(4) It is preferable that a connector-side engaging claw is formed on the connector housing, the connector-side engaging claw engaging with a main body-side engaging claw of a main body-side housing that is fixed to the first object to be connected or the second object to be connected, and the connector housing is biased by a biasing portion that biases the connector housing against the main body-side housing such that the main body-side engaging claw and the connector-side engaging claw are brought into close contact with each other.

With this configuration, the connector housing can be brought into close contact with the main body-side housing, and therefore looseness of the connector housing with respect to the main body-side housing can be suppressed. Consequently, the generation of abrasion powder that may be caused by, for example, the contacts rubbing against each other or the contact and the housing rubbing against each other can be suppressed.

(5) To address the above-described problem, an electrical connection device according to an aspect of the invention is an electrical connection device including any of the above-described connectors, the connector including a terminal portion and a connector housing in which the terminal portion is accommodated and electrically connecting a first object to be connected and a substrate serving as a second object to be connected via the terminal portion, a main body-side female contact that is formed as a female contact and connected to the substrate, and a main body-side housing that is fixed to the substrate.

With this configuration, the electrical connection device can include the connector having the terminal portion in which the joint portion has a secured sufficient length, and therefore an electrical connection device having excellent vibration resistance can be provided.

Moreover, a terminal portion according to another aspect of the invention is a terminal portion that is accommodated in a connector housing of a connector electrically connecting a first object to be connected and a second object to be connected, wherein the terminal portion has a connector-side male contact that is inserted into a main body-side female contact connected to the first object to be connected, a connector-side female contact into which a main body-side male contact connected to the second object to be connected is inserted, and an elastically deformable joint portion that joins the connector-side male contact and the connector-side female contact to each other.

With this configuration, as described above, the male contact is formed on one side of the terminal portion, and the female contact is formed on the other side of the terminal portion. This enables the joint portion to have a longer length than in the case where female contacts are formed at both end portions of the terminal portion, for example. More specifically, since the male contact has a simplified configuration when compared with the female contact, the male contact-side end portion of the joint portion can be formed so as extend to the male contact side. Thus, the length of the joint portion of the terminal portion can be longer when compared with the case where female contacts are formed at both end portions of the terminal portion. Consequently, even if the two objects to be connected vibrate independently of each other, the vibrations can be absorbed by the joint portion having a secured sufficient length.

Therefore, with this configuration, a terminal portion that is suitable for a connector having excellent vibration resistance can be provided.

It should be noted that the forgoing and other objects, features, and advantages of the invention will become apparent upon reading the following description with reference to the accompanying drawings.

DETAILED DESCRIPTION OF THE INVENTION

Hereinafter, embodiments of the present invention will be described with reference to the drawings. The present invention is widely applicable to a connector that electrically connects two objects to be connected and an electrical connection device including this connector.

Configuration

Figure 1:
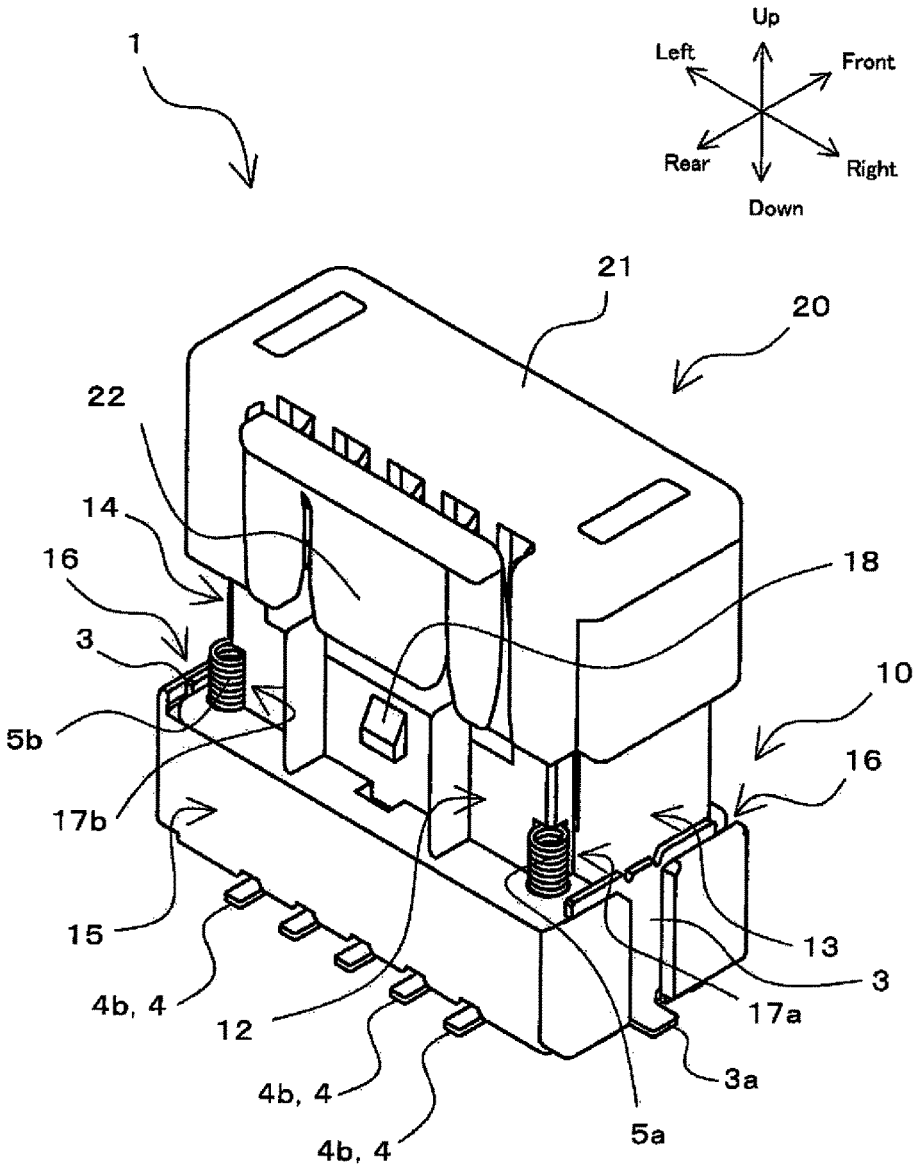
FIG. 1 is a perspective view schematically showing a connector and an electrical connection device including this connector according to an embodiment of the present invention.
Figure 2A:
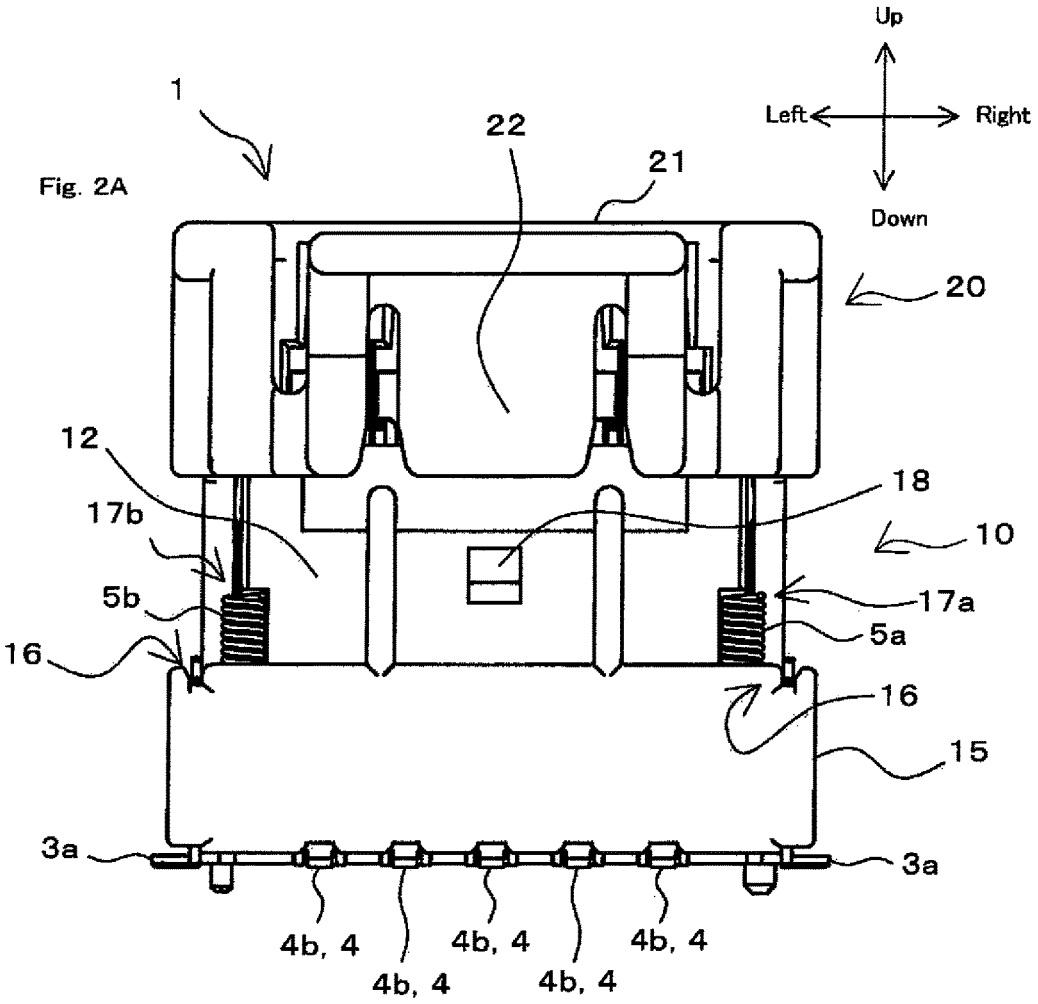
FIG. 2A is a rear view of the electrical connection device shown in FIG. 1.
Figure 2B:
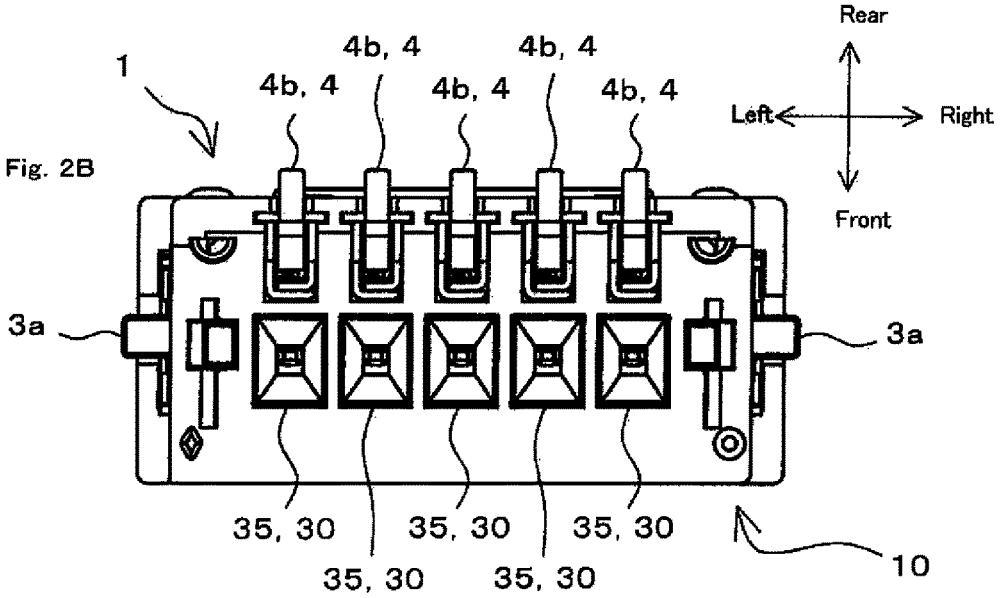
FIG. 2B is a bottom view of the electrical connection device shown in FIG. 1.
Figure 3:
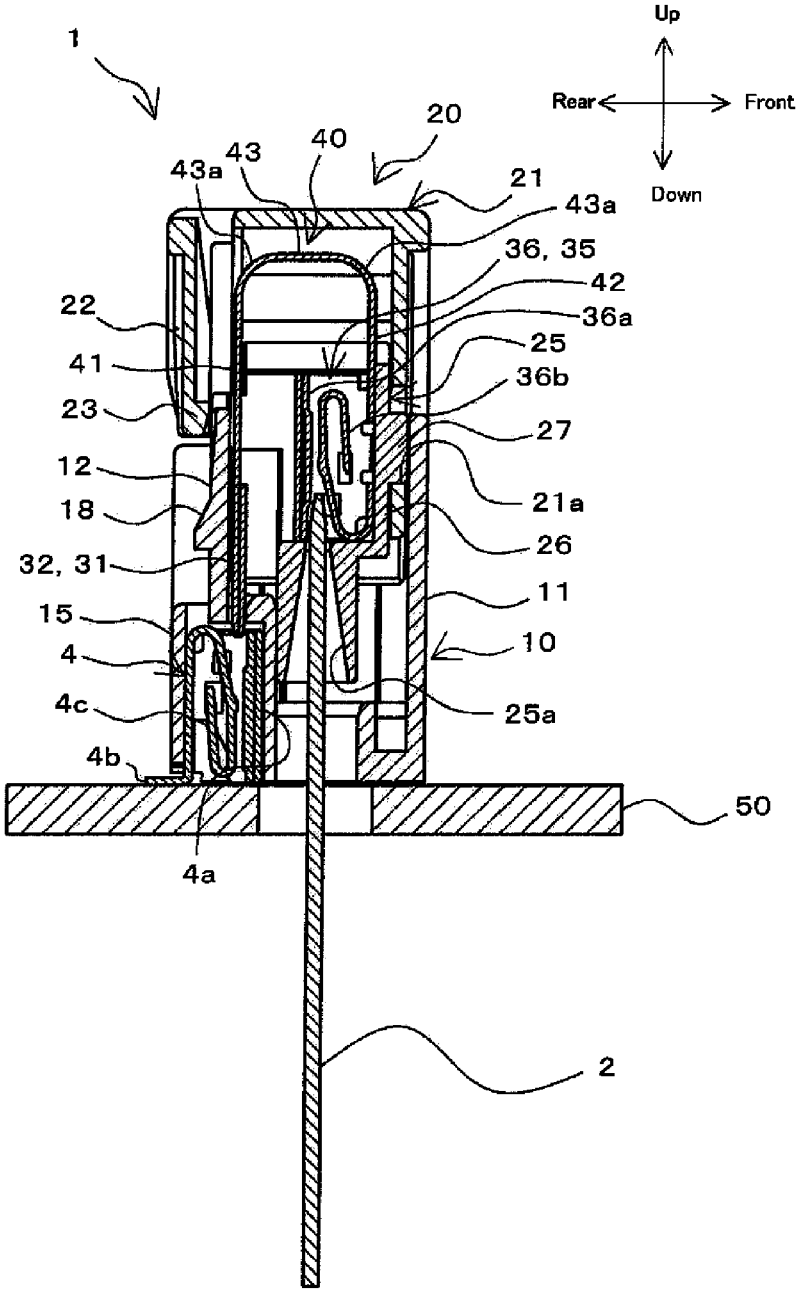
FIG. 3 is a vertical cross-sectional view of the electrical connection device shown in FIG. 1 and shows a state before the connector is fitted to a main body-side housing.

FIG. 1 is a perspective view schematically showing a connector 20 and an electrical connection device 1 including this connector 20 according to an embodiment of the present invention. FIG. 2A is a rear view of the electrical connection device 1 shown in FIG. 1, and FIG. 2B is a bottom view of the electrical connection device 1 shown in FIG. 1. FIG. 3 is a vertical cross-sectional view of the electrical connection device 1 shown in FIG. 1 and shows a state before the connector 20 is fitted to a main body-side housing 10. The electrical connection device 1 according to the present embodiment may be used in automobiles, for example, in order to electrically connect a busbar (not shown) to a substrate 50 of a device (not shown) to which power is supplied from the busbar. It should be noted that in the drawings, for convenience of description, the direction indicated by the arrow denoted by "Front" is referred to as "front side" or "forward", the direction indicated by the arrow denoted by "Rear" is referred to as "rear side" or "rearward", the direction indicated by the arrow denoted by "Right" is referred to as "right side", the direction indicated by the arrow denoted by "Left" is referred to as "left side", the direction indicated by the arrow denoted by "Up" is referred to as "upper side" or "upward", and the direction indicated by the arrow denoted by "Down" is referred to as "lower side" or "downward". The up-down direction corresponds to the direction in which the connector 20 is inserted and removed.

The electrical connection device 1 includes main body-side male contacts 2, the main body-side housing 10, reinforcing tabs 3, main body-side female contacts 4, the connector 20, and the like.

Each of the main body-side male contacts 2 is a conductive member formed in the shape of a pin, and is fixed to the busbar. The main body-side male contacts 2 thus have the same potential as the busbar. It should be noted that although each main body-side male contact 2 is formed in the shape of a pin in the present embodiment, the main body-side male contacts 2 are not limited to a pin shape and may have any shape as long as they are formed as contacts of a so-called male type. For example, the main body-side male contacts 2 may also each be formed by bending a narrow strip of sheet metal into a rod shape.

The main body-side housing 10 is a resin member formed in a substantially rectangular tube shape extending in the up-down direction. When viewed from above, the main body-side housing 10 is formed in a rectangular shape that is elongated in the left-right direction. Specifically, the main body-side housing 10 has a front wall portion 11, a rear wall portion 12, a right wall portion 13, and a left wall portion 14, and these wall portions are formed as a single member having the substantially rectangular tube shape.

A step portion 15 is formed in a lower portion of the rear wall portion 12 of the main body-side housing 10, the step portion 15 being formed in a step shape protruding rearward from that lower portion. Also, slit portions 16 passing through the main body-side housing 10 in the up-down direction are formed on both the left and right sides of the main body-side housing 10.

Also, two coil spring accommodating portions 17*a* and 17*b* are formed in the main body-side housing 10. Specifically, one coil spring accommodating portion 17*a* is formed by a groove-shaped cut-out portion in a lower portion of a corner portion between the rear wall portion 12 and the right wall portion 13. The other coil spring accommodating portion 17*b* is formed by a groove-shaped cut-out portion in a lower portion of a corner portion between the rear wall portion 12 and the left wall portion 14. Coil springs 5*a* and 5*b* are placed extending in the up-down direction within the respective coil spring accommodating portions 17*a* and 17*b*.

Also, a main body-side engaging claw 18 is formed on the main body-side housing 10. Specifically, the main body-side engaging claw 18 is formed in a middle portion of the rear wall portion 12 with respect to the left-right direction and located slightly above the step portion 15. The main body-side engaging claw 18 is formed projecting rearward from the rear wall portion 12. The main body-side engaging claw 18 is engageable with a connector-side engaging claw 23 of a connector housing 21, which will be described in detail later.

The reinforcing tabs 3 are each formed by bending a portion of a metal plate-shaped member. Each reinforcing tab 3 is provided in such a manner that in a state in which the reinforcing tab 3 is inserted into and fixed in the corresponding slit portion 16 of the main body-side housing 10, a flat bent portion 3*a* that is bent as described above faces downward. The reinforcing tabs 3 are respectively press-fitted into and fixed in the two slit portions 16.

The main body-side housing 10 is fixed to the substrate 50 by the bent portions 3*a* of the reinforcing tabs 3, which are fixed to the main body-side housing 10 in the above-described manner, being soldered to the substrate 50.

Figure 4:
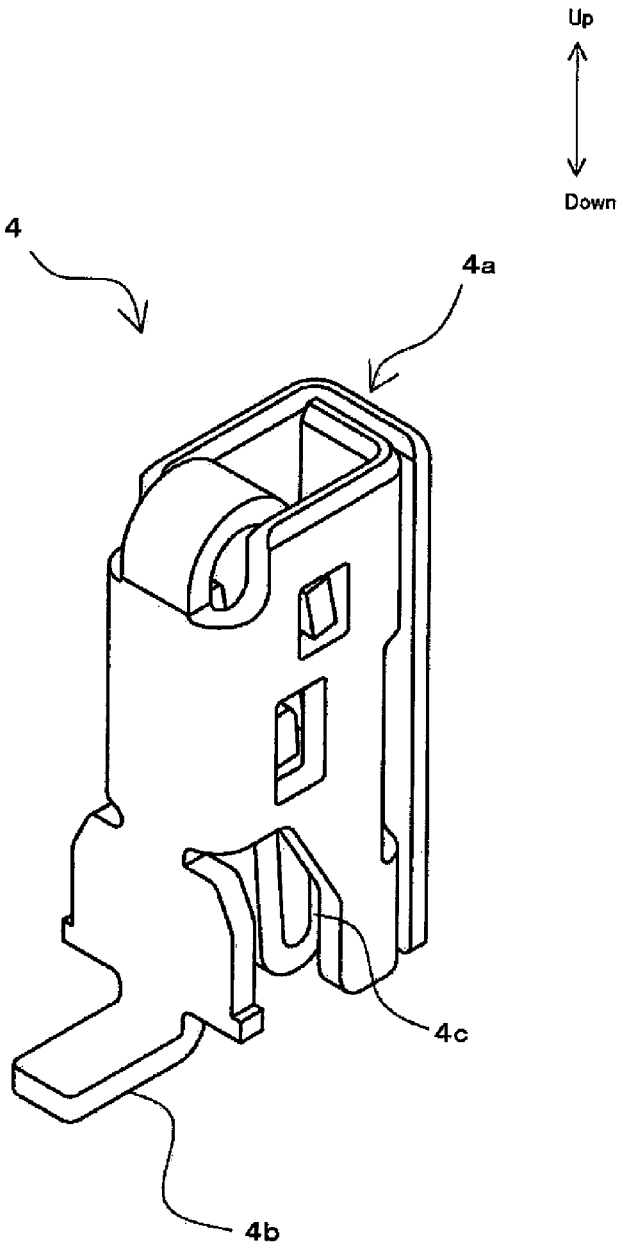
FIG. 4 is a perspective view showing a shape of a main body-side female contact.

FIG. 4 is a perspective view showing the shape of a single main body-side female contact 4. Each main body-side female contact 4 is formed in a shape such as that shown in FIG. 4 by bending a metal sheet formed through press punching, for example. The main body-side female contact 4 has a rectangular tube portion 4*a* formed in a rectangular tube shape and a soldered portion 4*b*, and these portions are formed as a single member. A spring portion 4*c* is formed inside the rectangular tube portion 4*a*. The spring portion 4*c* holds a connector-side male contact 31 (described in detail later) inserted into the rectangular tube portion 4*a* between the rectangular tube portion 4*a* and the spring portion 4*c*. In the present embodiment, five main body-side female contacts 4 are arranged in a line in the left-right direction and accommodated in the main body-side housing 10 fixed to the substrate 50 in a state in which the soldered portions 4*b* of the respective main body-side female contacts 4 are soldered to the substrate 50. In this state, an upper opening of each main body-side female contact 4 is exposed upward through an upper opening of the main body-side housing 10.

Configuration of Connector

Figure 5A:
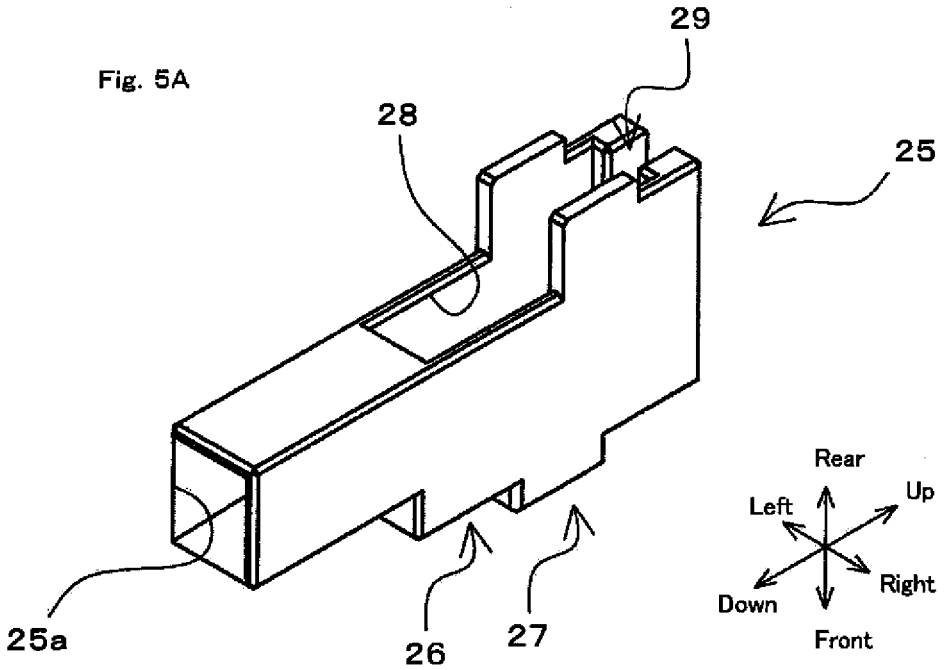
FIG. 5A is a perspective view of a core housing.
Figure 5B:
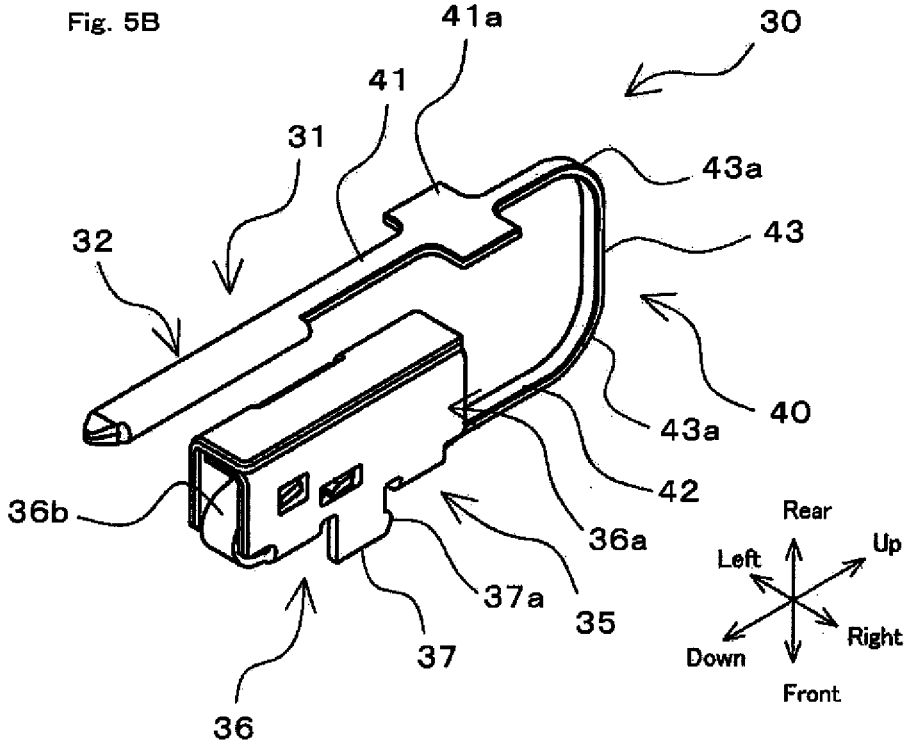
FIG. 5B is a perspective view of a terminal portion.
Figure 6:
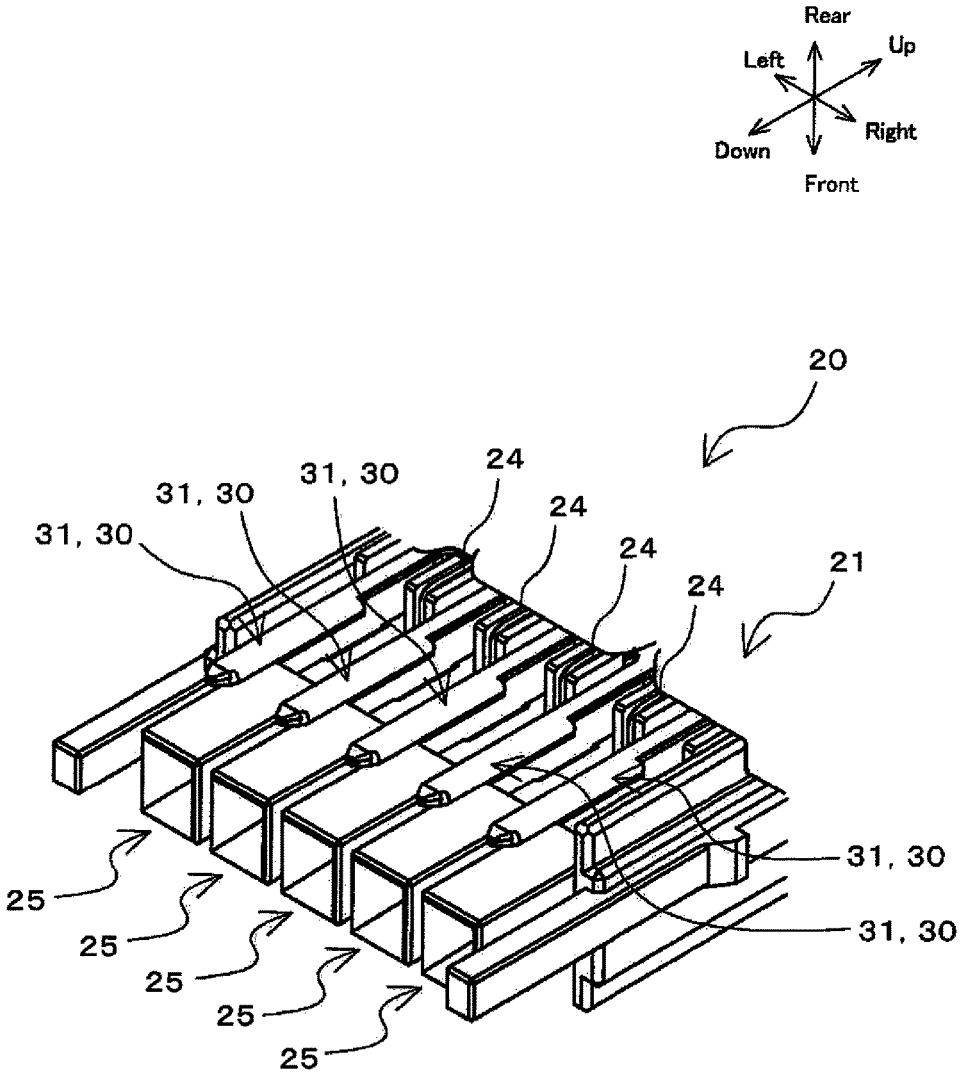
FIG. 6 is a perspective view showing a state in which core housings into which respective terminal portions are inserted are accommodated in a connector housing whose upper portion is not shown.

FIG. 5A is a perspective view of a core housing 25. FIG. 5B is a perspective view of a terminal portion 30. FIG. 6 is a perspective view showing a state in which core housings 25 into which respective terminal portions 30 are inserted are accommodated in the connector housing 21 whose upper portion is not shown.

The connector 20 has the connector housing 21, the core housings 25, and the terminal portions 30 and is formed by assembling these members together.

Referring to FIGS. 1 to 3, the connector housing 21 may be a member formed by resin molding, for example. The core housings 25 and the terminal portions 30 are inserted into the connector housing 21 from an opening side, the opening being formed on the lower side of the connector housing 21, and thus the core housings 25 and the terminal portions 30 are accommodated inside the connector housing 21.

A cantilevered claw portion 22 is formed in a rear portion of the connector housing 21, the cantilevered claw portion 22 having the connector-side engaging claw 23 that is engageable with the main body-side engaging claw 18, which is formed on the rear wall portion 12 of the main body-side housing 10. The connector-side engaging claw 23 is formed projecting forward from a lower front portion of the claw portion 22. The claw portion 22 is formed such that its lower portion can bend in the front-rear direction with its upper portion serving as a base end portion.

Figure 7B:
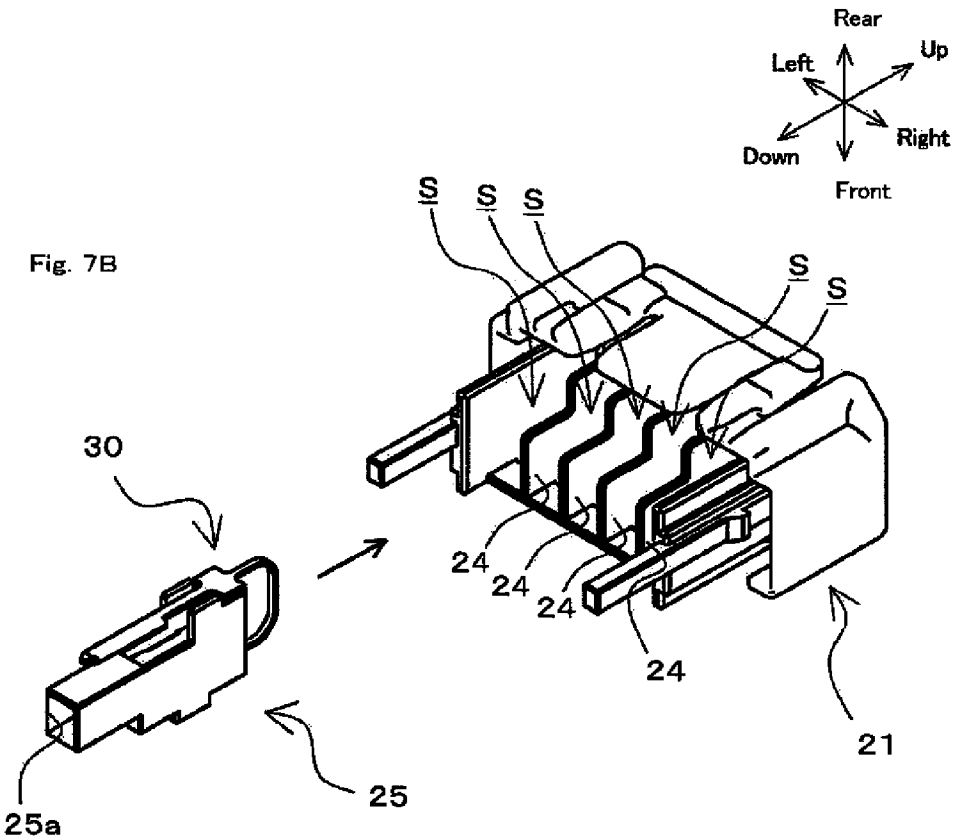
FIG. 7B is an explanatory diagram of the assembly process of the connector and shows how the core housing and the terminal portion that have been combined with each other are inserted into the connector housing.

Moreover, four partition walls 24 that partition an inner space of the connector housing 21 into five spaces S are formed inside the connector housing 21 (see FIG. 7B). The partition walls 24 are each formed extending in the front-rear direction and the up-down direction and are arranged in the left-right direction at regular intervals. One core housing 25 and a corresponding terminal portion 30 that are combined with each other are inserted into each of the five spaces S demarcated by these partition walls 24, as will be described in detail later.

Each core housing 25 may be a member that is made of a resin material, for example, and that is formed in a substantially rectangular tube shape extending in the up-down direction as shown in FIG. 5A. A first protruding portion 26 is formed in an upper portion of a front wall portion of the core housing 25, the first protruding portion 26 protruding outward in such a manner as to form a step. Furthermore, a second protruding portion 27 is formed at a central portion of the first protruding portion 26 with respect to the up-down direction, the second protruding portion 27 protruding in the same direction as the first protruding portion 26 in such a manner as to form a step. Moreover, a first opening 28 is formed in an upper portion of a rear wall portion of the core housing 25, the first opening 28 opening rearward. Furthermore, a cut-out portion 29 is formed in upper portions of both left and right wall portions of the core housing 25, the cut-out portion 29 being cut out from the rear side toward the front side.

Each terminal portion 30 is formed in a shape such as that shown in FIG. 5B by bending a metal sheet formed through press punching, for example. Each terminal portion 30 has a male contact 31 (connector-side male contact), a female contact 35 (connector-side female contact), and a joint portion 40, and these portions are formed as a single member.

The male contact 31 is constituted by a contact portion 32. As shown in FIG. 5B, the contact portion 32 is formed by folding a plate-shaped portion along a fold line extending in the up-down direction. The contact portion 32 is thus formed in a substantially rod-like shape elongated in the up-down direction and having a predetermined thickness.

The female contact 35 is constituted by a contact portion 36 having a rectangular tube portion 36*a* and a spring portion 36*b*. The rectangular tube portion 36*a* is formed in a rectangular tube shape extending in the up-down direction. The spring portion 36*b* is formed inside the rectangular tube portion 36*a* integrally with the rectangular tube portion 36*a*. In the female contact 35, when the main body-side male contact 2 is inserted into the rectangular tube portion 36*a*, the main body-side male contact 2 is held between an inner portion of the rectangular tube portion 36*a* and the spring portion 36*b*. Moreover, a projecting piece 37 is formed integrally with the female contact 35. The projecting piece 37 is formed projecting forward from a central portion of the female contact 35 with respect to the up-down direction. A protruding portion 37*a* protruding upward is formed in a leading end portion of the projecting piece 37.

Since the male contact 31 has a relatively simple shape as is described above, the overall size of the male contact 31 is slightly smaller than that of the female contact 35, which has a more complicated shape than the male contact 31.

The joint portion 40 has a first straight line portion 41, a second straight line portion 42, and a connecting portion 43, which are formed as a single portion having a U-shape.

The first straight line portion 41 is a straight line-shaped portion that is formed extending in the up-down direction, and is continuous with the male contact 31 on one end side (lower side). A wide portion 41*a* is formed in a central portion of the first straight line portion 41 with respect to the up-down direction, the wide portion 41*a* being wider than the first straight line portion 41 in the left-right direction.

The second straight line portion 42 is a straight line-shaped portion that is formed extending in the up-down direction, and is continuous with the female contact 35 on one end side (lower side). The second straight line portion 42 is provided extending parallel to the first straight line portion 41. Moreover, the second straight line portion 42 is slightly shorter than the first straight line portion 41 in the up-down direction.

The connecting portion 43 is provided extending in a direction that is orthogonal to the first straight line portion 41 and the second straight line portion 42, and connects an upper end portion of the first straight line portion 41 and an upper end portion of the second straight line portion 42 to each other. Both end portions of the connecting portion 43 are provided as curved portions 43*a* that are each formed to have a circular arc shape. Thus, even if an external force is exerted on the terminal portion 30, the concentration of stress on a connection area between the first straight line portion 41 and the connecting portion 43 and a connection area between the second straight line portion 42 and the connecting portion 43 can be avoided.

Assembly Process of Connector

Figure 7A:
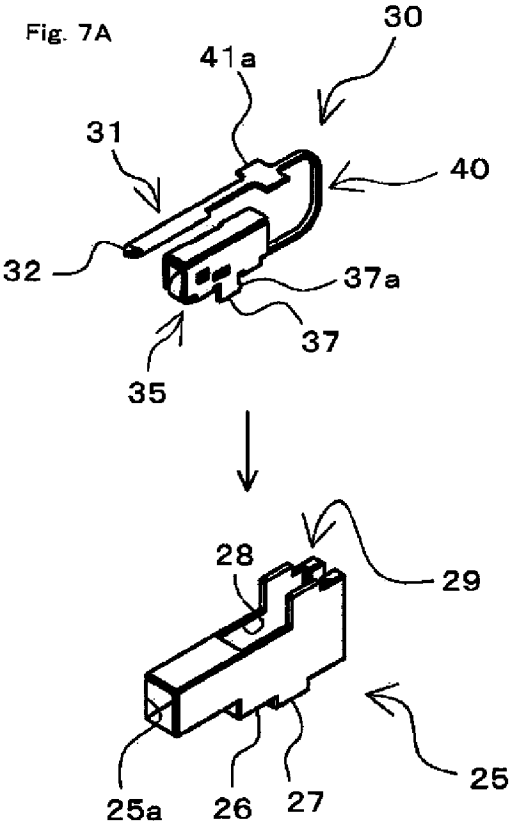
FIG. 7A is an explanatory diagram of an assembly process of the connector and shows how the core housing and the terminal portion are combined with each other.

FIG. 7A is an explanatory diagram of an assembly process of the connector 20 and shows how one core housing 25 and a corresponding terminal portion 30 are combined with each other. FIG. 7B is an explanatory diagram of the assembly process of the connector 20 and shows how the core housing 25 and the terminal portion 30 that have been combined with each other are inserted into the connector housing 21. It should be noted that the shape of an upper portion of the connector housing 21 in FIG. 7B is shown schematically.

During assembly of the connector 20, first, the core housing 25 and the terminal portion 30 are combined with each other as shown in FIG. 7A. Specifically, the female contact 35 is inserted into the core housing 25 from the first opening 28 side such that the projecting piece 37 of the female contact 35 is accommodated in the second protruding portion 27 of the core housing 25. Thus, the projecting piece 37 and the protruding portion 37*a* are press-fitted into the second protruding portion 27, and therefore unintentional disengagement of the terminal portion 30 from the core housing 25 can be prevented. Moreover, at this time, the contact portion 32 of the male contact 31 and the contact portion 36 of the female contact 35 are arranged so as to face downward. It should be noted that in the state in which the core housing 25 and the terminal portion 30 are combined with each other in the above-described manner, the wide portion 41*a* is placed on top of the cut-out portion 29 of the core housing 25. In the present embodiment, five terminal portions 30 are respectively combined with five core housings 25.

Next, the above-described core housing 25 to which the corresponding terminal portion 30 is attached is inserted into the connector housing 21. Specifically, the core housing 25 is inserted into the corresponding space S (see FIG. 7B) demarcated by the partition walls 24 such that a second opening 25*a* of the core housing 25 faces downward. At this time, the core housing 25 is inserted into the connector housing 21 until the second protruding portion 27 is inserted into a slit 21*a* (see FIG. 3) that is formed in the front wall portion of the connector housing 21. Thus, unintentional disengagement of the core housing 25 from the connector housing 21 is prevented. The core housings 25 to which the respective terminal portions 30 are attached are fixed to the connector housing 21 in the above-described manner, and thus assembly of the connector 20 is complete.

Fitting of Connector to Main Body-Side Housing

Figure 8B:
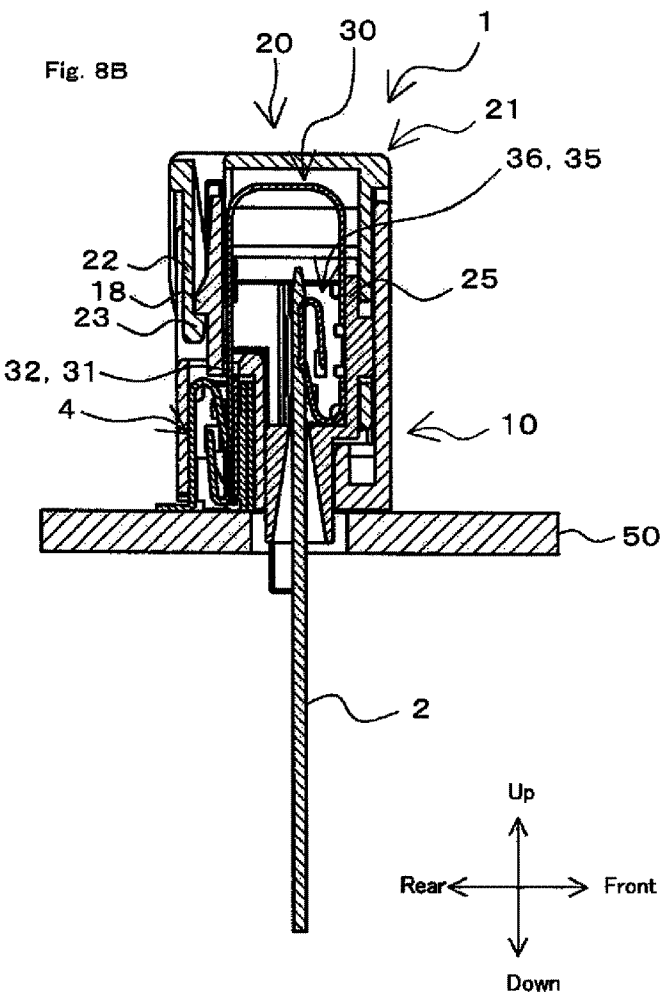
FIG. 8B is an explanatory diagram of the operation for fitting the connector to the main body-side housing and shows a state in which fitting of the connector into the main body-side housing is complete.
Figure 8A:
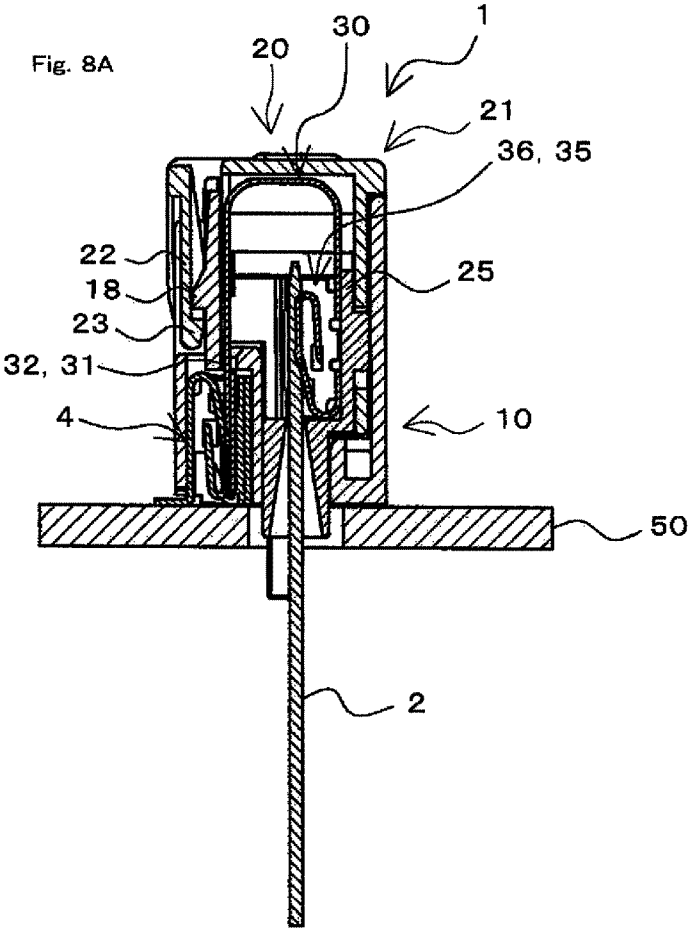
FIG. 8A is an explanatory diagram of an operation for fitting the connector to the main body-side housing and shows a state in which the connector is pressed down to a position that is nearest to a substrate.

FIG. 8A is an explanatory diagram of an operation for fitting the connector 20 to the main body-side housing 10 and shows a state in which the connector 20 is pressed down to a position that is nearest to the substrate 50. FIG. 8B is an explanatory diagram of the operation for fitting the connector 20 to the main body-side housing 10 and shows a state in which fitting of the connector 20 to the main body-side housing 10 is complete. Hereinafter, the operation for fitting the connector 20 to the main body-side housing 10 will be described with reference to FIGS. 3, 8A, and 8B.

In the state in FIG. 3, that is to say, in the state before the connector 20 is fitted to the main body-side housing 10, the main body-side contacts (male contacts 2 and female contacts 4) are not in contact with the connector-side contacts (female contacts 35 and male contacts 31), and therefore the busbar and the device having the substrate 50 are not electrically connected to each other. In this state, when the connector 20 is pressed down toward the substrate 50, the connector 20 moves to the main body-side housing 10 side. Accordingly, the female contacts 35 on the connector 20 side move to the male contact 2 side, and the male contacts 2 are thus inserted into the female contacts 35. Meanwhile, the male contacts 31 on the connector 20 side are inserted into the female contacts 4. As a result, the male contacts 2 are electrically connected to the female contacts 35, and the male contacts 31 are also electrically connected to the female contacts 4. Thus, the busbar and the device having the substrate 50 can be electrically connected to each other.

When the connector 20 is pressed down toward the substrate 50 as described above, a rear portion of the connector housing 21 abuts against the coil springs 5*a* and 5*b*. When the connector 20 is further pressed down toward the substrate 50 against the biasing force of the coil springs 5*a* and 5*b*, the connector 20 moves further to the main body-side housing 10 side.

Figure 9:
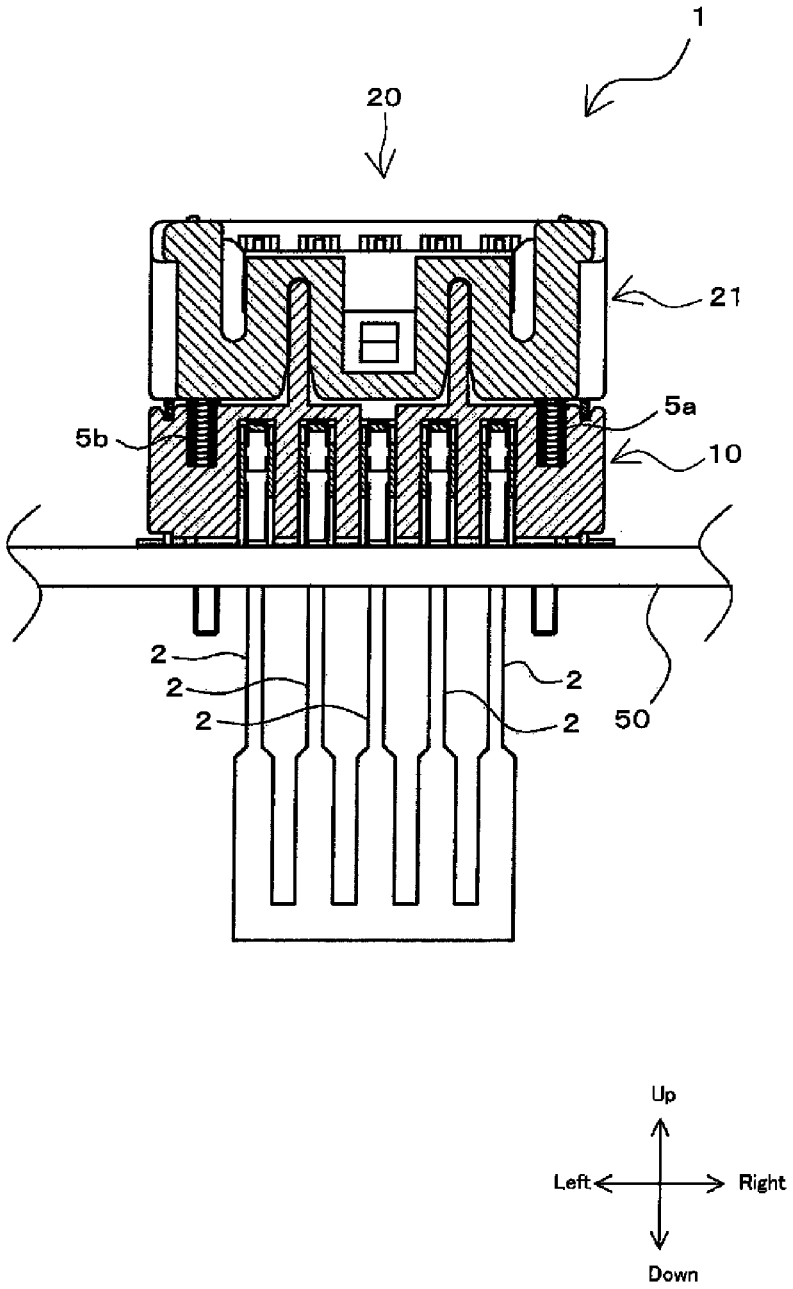
FIG. 9 is a vertical cross-sectional view of the electrical connection device shown in FIG. 1 taken along a plane different from that of FIG. 3 and shows the state in which the connector is pressed down to the position that is nearest to the substrate.

Moreover, as the connector 20 is pressed down toward the substrate 50 against the biasing force of the coil springs 5*a* and 5*b* as described above, the connector-side engaging claw 23 passes over the main body-side engaging claw 18 with a leading end portion of the claw portion 22 of the connector 20 bending rearward. As a result, the connector-side engaging claw 23 becomes located below the main body-side engaging claw 18 (see FIG. 8A). It should be noted that FIG. 9 is a cross-sectional view of the electrical connection device 1 when viewed from the rear side and shows the state in which the connector 20 is pressed down to the position that is nearest to the substrate 50.

In the state in which the connector 20 is pressed down to the position that is nearest to the substrate 50 as described above, if the pressing force on the connector 20 toward the substrate 50 is released, the biasing force of the coil springs 5*a* and 5*b* pushes the connector 20 upward, bringing the connector-side engaging claw 23 and the main body-side engaging claw 18 into close contact with each other in the up-down direction. Thus, the connector 20 can be fitted to the main body-side housing 10 without looseness of the connector housing 21 with respect to the main body-side housing 10.

Vibration Resistance of Connector

As described above, the electrical connection device 1 according to the present invention may be used in automobiles, for example, and therefore may be used in an environment that is relatively often exposed to vibrations. Furthermore, in the present embodiment, the busbar, which is a first object to be connected, and the device, which is a second object to be connected, are provided separately from each other and thus vibrate in different vibration modes. In this case, it can be conceived that, for example, when a component (e.g., main body-side male contact 2) fixed to the busbar side and a component (e.g., main body-side housing 10) fixed to the substrate 50 side rub against each other, or a component (e.g., main body-side housing 10) fixed to the substrate 50 side and a portion (e.g., male contact 31) fixed to the connector 20 side rub against each other, the components may be significantly abraded.

However, in the connector 20 according to the present embodiment, the male contact 31 is formed on one side of each terminal portion 30. Thus, the length of the joint portion 40 can be increased, the joint portion 40 joining the contacts 31 and 35 formed in opposite end portions of the terminal portion 30. More specifically, since the male contact 31 has a simplified configuration and a small size when compared with the female contact 35, the end portion (lower end portion of the first straight line portion 41) of the joint portion 40 on the male contact 31 side can be formed so as to extend to the male contact 31 side. Thus, the length of the joint portion can be longer when compared with the case where female contacts are formed on both end sides of the terminal portion, for example. Consequently, even if the two objects to be connected (the busbar and the device having the substrate 50 in the case of the present embodiment) vibrate independently of each other, the vibrations can be absorbed by the joint portion 40 having a secured sufficient length.

EFFECTS

As described above, in the connector 20 according to the present embodiment, the length of the joint portion 40 can be increased as described above. Therefore, with the connector 20, a connector having excellent vibration resistance can be provided.

Moreover, in the connector 20, the joint portion 40 is formed to have a U shape. Therefore, it is possible to accommodate the terminal portion 30 in a limited space within the connector housing 21 while securing a sufficient length of the joint portion 40.

Moreover, in the connector 20, the coil springs 5*a* and 5*b* can bring the connector housing 21 into close contact with the main body-side housing 10. Therefore, looseness of the connector housing 21 with respect to the main body-side housing 10 can be suppressed. Consequently, the generation of abrasion powder that may be caused by, for example, the contacts rubbing against each other or the contact and the housing rubbing against each other can be suppressed.

Moreover, with the electrical connection device 1 according to the present embodiment, an electrical connection device can include the connector 20, which has the terminal portion 30 in which the joint portion 40 having a secured sufficient length is formed. Therefore, an electrical connection device having excellent vibration resistance can be provided.

Moreover, with the terminal portion 30 according to the present embodiment, a terminal portion that is suitable for a connector having excellent vibration resistance can be provided.

Although an embodiment of the present invention has been described above, the present invention is not limited to the foregoing description, and various changes can be made thereto without departing from the gist of the present invention.

Figure 10:
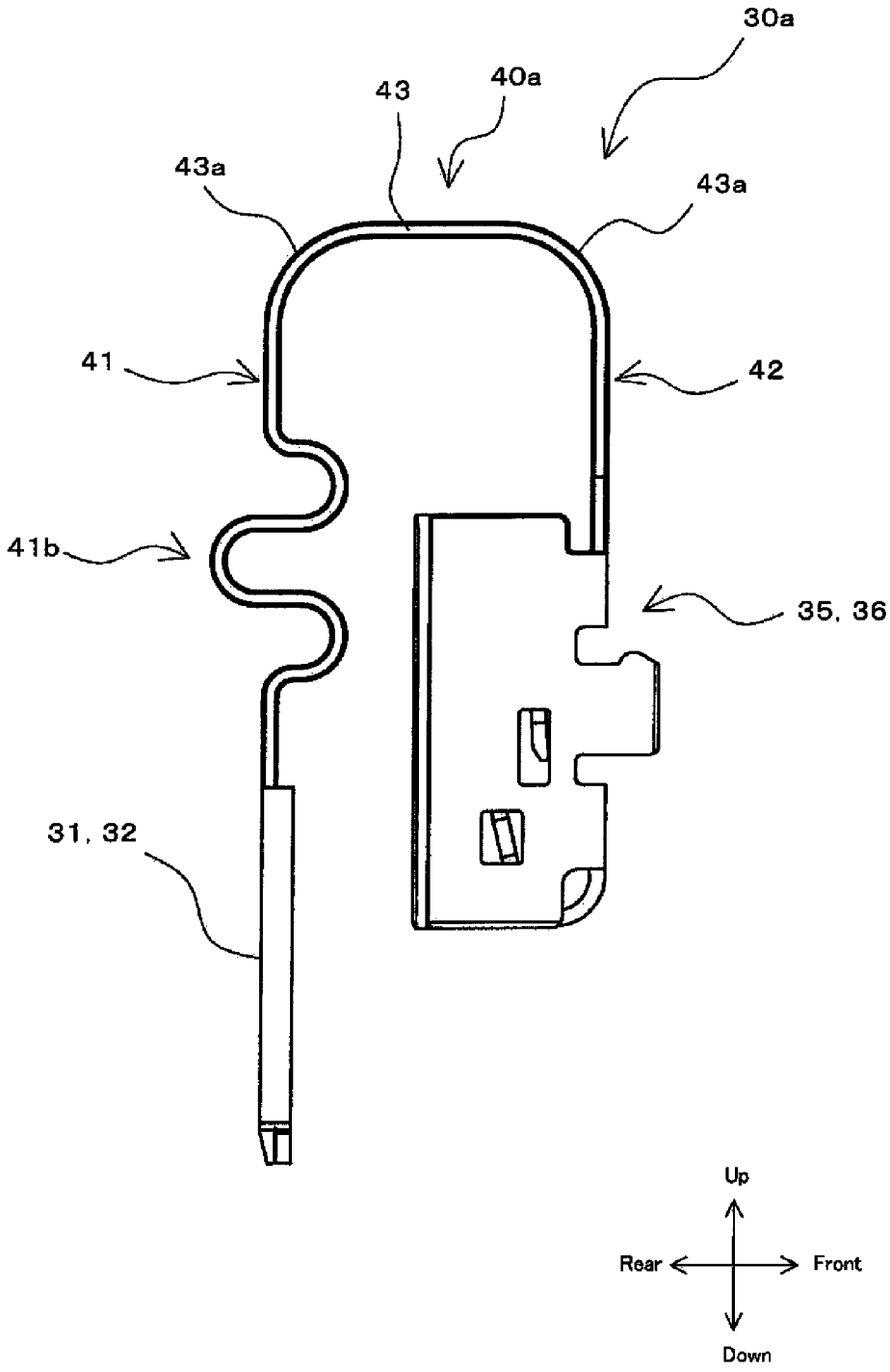
FIG. 10 is a plan view of the terminal portion of an electrical connection device according to a modification.

MODIFICATIONS (1) FIG. 10 is a plan view of a terminal portion 30*a* of a connector according to a modification. The terminal portion 30*a* of this modification differs from the terminal portion 30 of the foregoing embodiment in the shape of the joint portion. Hereinafter, mainly the differences from the foregoing embodiment will be described, and a description of the other portions is omitted.

In a joint portion 40*a* of this modification, unlike the foregoing embodiment, the wide portion 41*a* is not formed in the first straight line portion 41, but a meandering portion 41*b* (bent portion) is formed instead. The meandering portion 41*b* is formed extending in the up-down direction while meandering in the front-rear direction. Providing the meandering portion 41*b* in the first straight line portion 41 in this manner makes it possible to increase the length of the joint portion 40*a* when the joint portion 40*a* is spread out. Therefore, a connector having more excellent vibration resistance can be provided. Furthermore, with this configuration, spring properties can be imparted to the aforementioned meandering portion 41*b*. Therefore, a connector having even more excellent vibration resistance can be provided.

Figure 11:
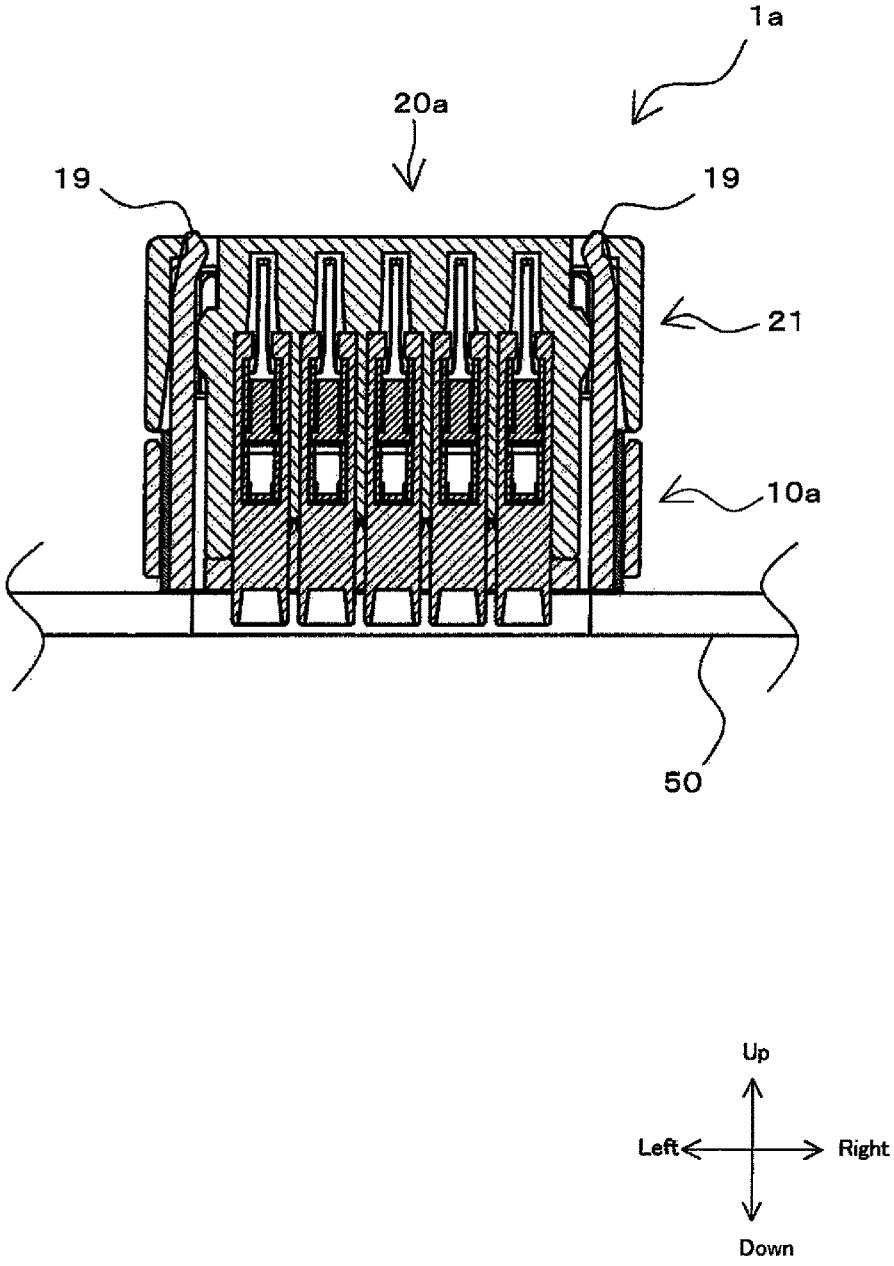
FIG. 11 is a vertical cross-sectional view of an electrical connection device according to a modification.

(2) FIG. 11 is a vertical cross-sectional view of an electrical connection device 1*a* according to a modification. In the foregoing embodiment, looseness of the connector 20 with respect to the main body-side housing 10 is suppressed by the coil springs 5*a* and 5*b*; however, the present invention is not limited to this configuration. Specifically, as shown in FIG. 11, looseness of a connector 20*a* may also be suppressed by resin springs 19.

In the example shown in FIG. 11, the resin springs 19 are formed in a main body-side housing 10*a*. The resin springs 19 are each formed extending upward from a lower portion of the main body-side housing 10*a*, and bias the connector 20*a* upward. With this configuration as well, looseness of the connector 20*a* with respect to the main body-side housing 10*a* can be suppressed as in the case of the foregoing embodiment.

The present invention is widely applicable as a connector that electrically connects two objects to be connected and an electrical connection device including this connector. The present invention is not limited to the above embodiment, and all modifications, applications, and equivalents thereof that fall within the claims, for which modifications and applications would become naturally apparent by reading and understanding the present specification, are intended to be embraced in the claims.

What is claimed is:

1. A connector comprising a terminal portion and a connector housing in which the terminal portion is accommodated and electrically connecting a first object to be connected and a second object to be connected via the terminal portion, wherein a main body-side male contact formed as a male contact is connected to the first object to be connected, a main body-side female contact formed as a female contact is connected to the second object to be connected, and the terminal portion has:

a connector-side male contact that is inserted into the main body-side female contact;

a connector-side female contact into which the main body-side male contact is inserted; and an elastically deformable joint portion that joins the connector-side male contact and the connector-side female contact to each other.

2. The connector according to claim 1, wherein the joint portion has:

a first straight line portion that is connected to the connector-side male contact on one end side;

a second straight line portion that is connected to the connector-side female contact on one end side, the second straight line portion being provided extending parallel to the first straight line portion; and a connecting portion that connects another end side of the first straight line portion and another end side of the second straight line portion to each other, the connecting portion being provided extending in a direction that is orthogonal to the first straight line portion and the second straight line portion.

3. The connector according to claim 2, wherein a bent portion is formed in the first straight line portion.

4. The connector according to claim 1, wherein a connector-side engaging claw is formed on the connector housing, the connector-side engaging claw engaging with a main body-side engaging claw of a main body-side housing that is fixed to the first object to be connected or the second object to be connected, and the connector housing is biased by a biasing portion that biases the connector housing against the main body-side housing such that the main body-side engaging claw and the connector-side engaging claw are brought into close contact with each other.

5. An electrical connection device comprising:

the connector according to claim 1, the connector comprising a terminal portion and a connector housing in which the terminal portion is accommodated and electrically connecting a first object to be connected and a substrate serving as a second object to be connected via the terminal portion;

a main body-side female contact that is formed as a female contact and connected to the substrate; and a main body-side housing that is fixed to the substrate.

* * * * *